United States Patent [19]

Heidner

[11] 4,359,975

[45] Nov. 23, 1982

[54] STARTING APPARATUS FOR TWO CYCLE ENGINE

[76] Inventor: Richard C. Heidner, 704 Spring Dr., West Bend, Wis. 53095

[21] Appl. No.: 180,879

[22] Filed: May 25, 1980

[51] Int. Cl.[3] ..... F02B 33/04; F02M 1/16; F04B 39/10

[52] U.S. Cl. ..... 123/73 R; 123/73 A; 123/73 PP; 123/187.5 R

[58] Field of Search ..... 123/187.5 R, 73 A, 73 R

[56] References Cited

U.S. PATENT DOCUMENTS

| | | | |
|---|---|---|---|
| 3,128,748 | 4/1964 | Goggi | 123/73 R |
| 3,132,635 | 5/1964 | Heidner | 123/73 A |
| 3,494,343 | 2/1970 | Nutten | 123/73 R X |
| 3,528,395 | 6/1970 | Goggi | 123/73 R |
| 3,762,380 | 10/1973 | Schultz | 123/73 R |
| 3,929,111 | 12/1975 | Turner | 123/73 PP |

FOREIGN PATENT DOCUMENTS

| | | | |
|---|---|---|---|
| 493290 | 10/1977 | Australia | 123/73 R |
| 1072407 | 2/1980 | Canada | 123/187.5 R |

*Primary Examiner*—Wendell E. Burns
*Attorney, Agent, or Firm*—Ronald E. Barry

[57] ABSTRACT

A two stroke cycle internal combustion engine having a closed crankcase adapted to receive a air-fuel mixture and a cylinder extending from said crankcase, a piston reciprocally movable in said cylinder which alternately produces a low pressure condition in said crankcase as it approaches top dead center and a high pressure condition in said cylinder as it approaches bottom dead center, a fuel reservoir for supplying liquid fuel to the air fuel mixture in said crankcase, a bypass passage connecting said crankcase to said cylinder, and a conduit connecting said crankcase to the fuel reservoir for pumping fuel accumulated in said crankcase during starting into said reservoir, and a unidirectional flow control device in said conduit for preventing return flow from said reservoir to said crankcase.

16 Claims, 3 Drawing Figures

STARTING APPARATUS FOR TWO CYCLE ENGINE

BACKGROUND OF THE INVENTION

Two cycle internal combustion engines are commonly fueled with variable boiling point liquid fuel: Starting of these engines when cold or at temperatures other than the normal operating temperatures requires the addition of extra liquid fuel into the combustible fuel-air mixture. The additional fuel is required to provide a sufficient quantity of vaporized fuel in the combustion air being conveyed to the combustion chamber. The conventional choke for controlling mixture enrichment is sometimes supplemented by a primer in order to inject the liquid fuel directly into the intake passage or transfer passage on the engine. It is difficult to determine when the correct amount of liquid fuel has been conveyed to the engine and frequently results in starting difficulty especially for those unskilled in determining whether the failure to start results from an inadequate or overabundant amount of liquid fuel. Since starting cannot occur if the air-fuel mixture reaching the sparkplug is leaner than the lean flammability limit, it is standard practice to instruct the operator to use sufficient choke and/or priming to provide a mixture sufficiently rich to be richer than the lean flammability limit. Since only the vaporized fuel contributes richness to the mixture, and the amount of fuel which vaporizes is dependent on temperature as well as the volatility of the fuel, it is difficult to provide choking and/or priming instructions which assure starting over the range of temperatures and fuel volatility normally encountered in starting engines. As a result, excessive choking or priming frequently occurs which results in a puddle of liquid fuel accumulating at the low point of the crankcase commonly known as flooding. This condition is corrected by continued rotation of the engine with the choke open and no additional fuel added until sufficient air has passed through the engine to lean-out the mixture within the limits of flammability. This frequently requires additional manual engine rotation beyond the patience and endurance of the operator.

SUMMARY OF THE INVENTION

The present invention overcomes this problem by providing choke and/or priming instructions assuring that an overabundance of fuel is delivered to the crankcase which provides a sufficient quantity of vaporized fuel to insure a mixture richer than the lean limit of flammability. Since flooding can easily occur under these conditions, a means is provided to rapidly remove excess fuel in the crankcase, thereby assuring that the engine will start with a minimum number of rotations even though an overly rich mixture is supplied prior to or during rotation of the engine by manual or other means. Although the technique of supplying an excessively rich mixture and progressing to a combustion mixture by engine rotation is an old art, the present invention substantially reduces the number of engine rotations required to achieve a combustible mixture which will start the engine. This is achieved by connecting the crankcase of a two-stroke engine to the fuel reservoir of the engine. The connection is made at a low point in the crankcase where the liquid fuel normally accumulates and is discharged into the reservoir near the highest liquid level in the reservoir. This connection incorporates means to assure that essentially uni-directional flow from the crankcase to the reservoir occurs. In one embodiment of the invention, a visual means is also provided to provide an indication of the accumulation of liquid in the crankcase to alert the operator that sufficient fuel is available and no further priming or choking is desirable. A flame quench device can be provided to prevent ignition of fuel in the reservoir on backfire.

IN THE DRAWINGS

DESTAILED DESCRIPTION OF THE ENGINE

Figure 1:
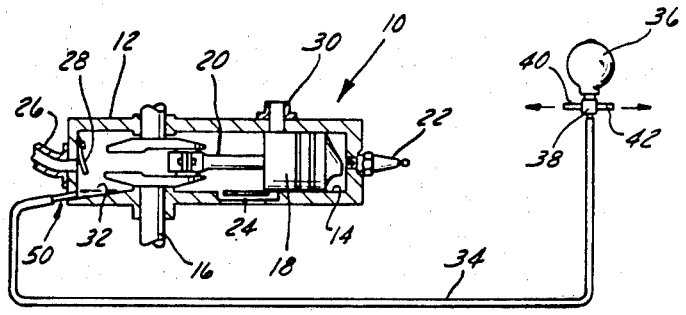
FIG. 1 is a schematic view of a two-cycle engine showing the connection of the crankcase to the fuel reservoir.

Referring to FIG. 1 of the drawings, a two-stroke cycle engine 10 is shown which includes a conventional engine crankcase 12 having a cylinder 14 at one end and a crankshaft 16 extending through the crankcase 12. A piston 18 is reciprocally movable within the cylinder 14 and is connected to the crankshaft 16 by means of a connecting rod 20. A spark plug 22 is provided at the top of the cylinder 14. A bypass or transfer passage 24 connects the crankcase 12 to the cylinder 14 when the piston 18 is at bottom dead center. As is generally understood, the crankcase 12 is connected to a source of air-fuel lubricant mixture through a line 26 which is controlled by menas of a reed valve 28 which is closed as the piston moves toward bottom dead center and is open as the piston moves towards top dead center. While a reed valve is shown, the invention is also applicable to engines with other valve means such as a rotary valve or third port. Air-fuel lubricant mixture confined within the crankcase 12 is forced through the transfer passage 24 for discharge into the cylinder 14 as the piston 18 reaches bottom dead center and is compressed in the cylinder 14 and ignited when the piston reaches a point near top dead center. The combustion products being discharged through the exhaust line 30 as is common practice.

In accordance with the invention, the crankcase 12 is provided with a single low point referred to as a sump 32 to accumulate liquid fuel and/or lubricant that may be present within the crankcase. The sump 32 is connected by a fuel return conduit or line 34 to a fuel reservoir 36. The fuel reservoir is shown as being connected through a T-connection 38 to a carburetor through connection 40 and a primer through a connection 42, although the invention is not limited to this fuel system arrangement.

Means are provided on the end of the conduit or line 34 for connecting the line to the reservoir without interfering with the flow of fuel from the reservoir to the carburetor or the primer. One such means is in the form of a standpipe 44 which extends through the T-connection 38 and terminates at a point above the normal level 46 of the fluid 48 in the reservoir. Any liquid fuel within the crankcase 12 will then be pumped into the reservoir to rapidly lean the mixture from the excessively rich condition to within the limits of flammability thus assuring starting within a minimum number of engine rotations.

In this regard, starting tests were run on a warm engine using ten primes as the basis for comparison in starting the engine. With the standpipe 44 in the reservoir the engine started on the seventh pull. With the conduit or line 34 disabled so that fuel could not flow to the reservoir, the engine started on the 28th pull. With the standpipe removed and leaving the conduit 34 open so that the accumulated liquid was pumped directly into the reservoir, the pulses from the conduit 34 adversely affected the fuel flow to the carburetor. No mixture adjustment could be obtained which provided satisfactory engine operation. The inclusion of the standpipe 44 eliminates this problem and also reduced the number of pulls to start a flooded engine. Other means connecting conduit 34 to the fuel reservoir, such as an opening into the top of the reservoir are also included in this invention.

Means are provided in the conduit 34 to restrict the flow of accumulated liquid through the line to single or uni-directional flow. One such means is acomplished by providing a check valve assembly 50 at the end of the conduit 34. The assembly 50 includes a ball 52 which is biased by means of a spring 54 into an engagement with a valve seat 56 provided at the end of the passage 58.

A refinement of the original invention also includes means in the reservoir 36 to visually determine if the engine has been primed sufficiently to reach the flammability limit. Such means is in the form of a viewing glass 60 provided in the top of the reservoir above the standpipe 44. It is generally understood that priming or choking is necessary in order to start an engine from a cold start. In order to reach the flammability limit, it is common practice to introduce more fuel into the crankcase than is necessary to reach the lean limit of flammability. Since the overabundance of fuel is liquid, it will accumulate in the sump 32. If the engine is rotated after priming and no fuel can be seen coming out of the standpipe 44, further priming is necessary. On the other hand, if fuel is observed flowing from the standpipe, then it can be determined that sufficient fuel is present in the crankcase to start the engine.

If the engine design is such that a puddle of fuel accumulates at the low point of the crankcase, during normal operation of the engine, this puddle will consist of the "heavy ends" of the fuel-oil mixture which are largely oil.

If these heavy ends are continuously returned to the fuel reservoir as the engine runs, the ratio of oil to fuel in the fuel reservoir will change to contain an excessive amount of oil as the liquid level in the reservoir is lowered. This excessively oil rich mixture can cause sparkplug fouling, smoky exhaust and accelerates the tendency for carbon to build up in the exhaust ports.

It is, therefore, not desirable to have all of the liquid in the crankcase returned to the fuel reservoir by this device when the engine is operating at normal speed.

One method of reducing the oil enrichment of the fuel in the reservoir, is to continuously circulate the liquid in the crankcase into the air stream.

An alternate method has been accomplished by tuning the check valve system and/or the length of the connection so it is inoperative at operating speeds. It is generally understood that an engine normally operates at speeds ten times faster than cranking speeds and, therefore, with proper tuning of the ball 50 and spring 52, and/or passage length, minimal flow can be produced through the check valve.

On occasion in a two stroke cycle engine, backfire will occur in the crankcase. This can occur if combustion continues in the combustion chamber after the piston clears the ports for the transfer passage 24. Normally the air-fuel mixture above the fuel in the fuel reservoir is usually richer than the rich flammability limit, however, it is possible for a flamable mixture to exist in the reservoir. Although remote, there is the possibility of a flamable mixture being present in the fuel reservoir at the time a backfire occurs. In order to protect the engine from this type of an occurrence, means can be provided in the return conduit or line 34 to quench the flame before it reaches the fuel reservoir.

Figure 3:
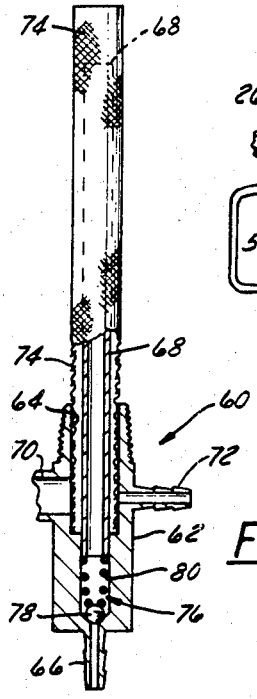
FIG. 3 is a view of an alternate form of standpipe which includes a flame quench device in the standpipe.
Figure 2:
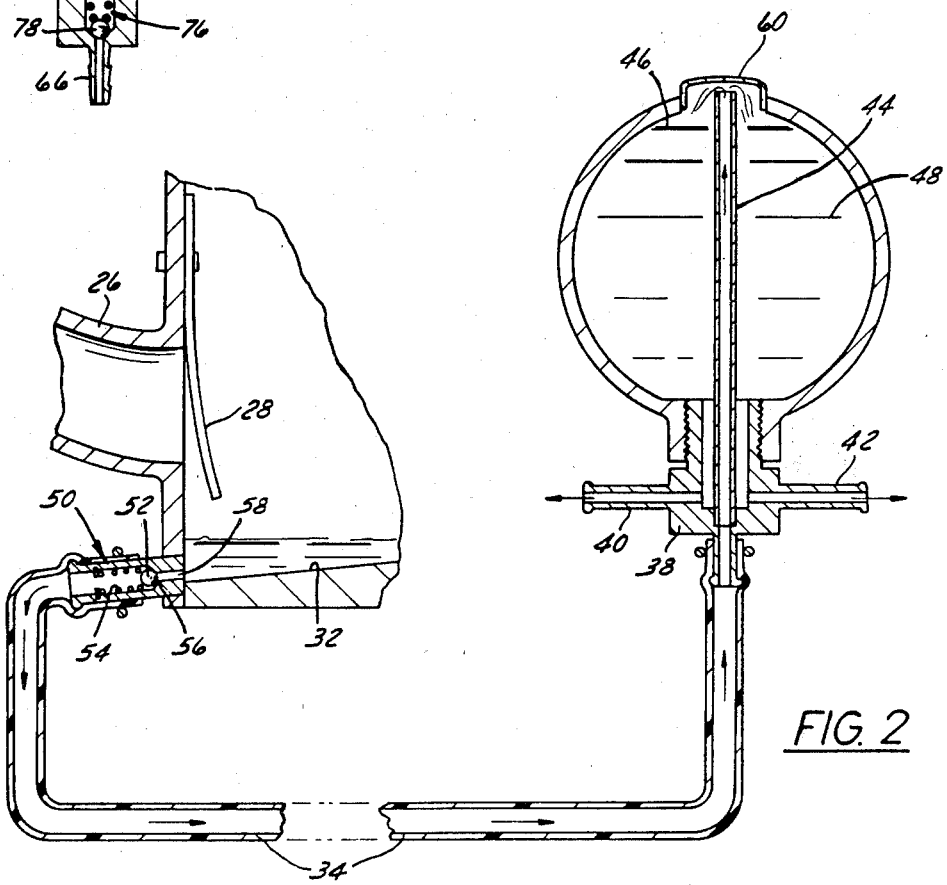
FIG. 2 is a diagramatic view partly in section showing the connection of the fuel reservoir to the crankcase of the engine.

In this regard and referring to FIG. 3, an alternate form of standpipe assembly 60 is shown which includes a housing 62 having a central bore 64. An inlet filling 66 is provided at one end and a standpipe 68 is provided at the other end. The central bore 64 is connected to the carburator through connection 70 and to a primer through connection 72.

Means are provided around the outside of standpipe 68 for quenching any flame which might enter the bore 64 through inlet fitting 66. Such means is in the form of tubular mesh screen 74 which surrounds and extends slightly beyond the end of pipe 68. A $\frac{1}{4}''$ diameter 200 mesh screen is sufficient for this purpose. The screen also acts as a filter for gas flow from the reservoir to the connections 70 and 72. This type of quench device is commonly used for this purpose. The screen can also be placed in the crankcase at the inlet end of the conduit 34. The standpipe under ordinary circumstances will be sufficient to provide flame quench protection since it is cooled by the fuel in the reservoir.

Means can also be provided in the bore 64 for limiting fuel flow to a single flow direction. Such means is in the form of a check valve assembly 76 located at the end of inlet fitting 66. The assembly includes a ball 78 and spring 80 which releases the ball into engagement with the end of fitting 66. If a check valve is provided in the housing 62, the check valve assembly 50 at the crankcase end of the conduit 34 can be eliminated.

The embodiments of the invention in which an exclusive property or privilege is claimed, are defined as follows:

1. In an internal combustion engine including a generally closed crankcase adapted to receive a combustion air-fuel mixture from a carburetor during a condition of low pressure, a cylinder extending from said crankcase, a piston reciprocally movable in said cylinder, whereby there is alternately developed in said crankcase a low pressure condition as said piston approaches top dead center and a high pressure condition as said piston approaches bottom dead center, a fuel reservoir remote from the carburetor for supplying liquid fuel to the carburetor to provide a combustible air-fuel mixture to the crankcase, and a bypass passage extending from said crankcase to said cylinder to permit entry of said mixture into said cylinder as said piston approaches bottom dead center.

the improvement comprising means for pumping the excess liquids accumulated in said crankcase during cranking of the engine into said remote fuel reservoir, said means including a conduit connecting the crankcase to a point above the normal level of fuel in said remote fuel reservoir, whereby the excess accumulated liquids are pumped into said remote fuel reservoir during cranking at a point above the normal level of the fuel in said remote reservoir.

2. The engine according to claim 1 wherein said pumping means includes a standpipe in said remote fuel reservoir connected to said conduit to provide a liquid discharge point above the normal liquid level in said remote fuel reservoir.

3. The engine according to claim 1 or 2, including means in said conduit for preventing backflow of fluid from the conduit into the crankcase.

4. The engine according to claim 3, wherein said preventing means opens essentially only at cranking speeds prevailing during a starting operation.

5. The engine according to claim 4 wherein said preventing means comprises a check valve.

6. The engine according to claim 1, 2 or 3, including means in said remote fuel reservoir for providing visual observation of said liquid returned to said remote fuel reservoir, whereby the operator can determine when fuel is present in the crankcase.

7. The engine according to claim 2 including means operatively connected to said conduit for quenching flame originating in said crankcase from entering said fuel reservoir.

8. The engine according to claim 7 wherein said flame quenching means comprises a mesh screen.

9. The engine according to claim 8 wherein said screen surrounds said standpipe.

10. An internal combustion engine including a generally closed crankcase having a cylinder therein and a piston reciprocally movable in said cylinder, a bypass passage extending from the crankcase to the cylinder to permit entry of a combustible air-fuel mixture into said cylinder when said piston approaches bottom dead center, a carburetor connected to said crankcase, a remote fuel reservoir connected to said carburetor and conduit means connecting said crankcase to said remote fuel reservoir for delivering excess fuel accumulated in said crankcase during priming of the engine to said remote fuel reservoir when said piston is moved toward bottom dead center, said conduit means being connected to said remote fuel reservoir above the normal level of fuel in said remote fuel reservoir.

11. The engine according to claim 10 including check valve means in said conduit means to prevent backflow of fuel into said crankcase.

12. The engine according to claim 10 or 11 including means for visually observing the flow of fuel from said conduit into said remote fuel reservoir.

13. The engine according to claim 10 wherein said conduit means includes means for quenching flame originating in said crankcase.

14. The engine according to claim 13 wherein said flame quenching means comprises a mesh screen located in said crankcase.

15. A method of starting a rear compression two-cycle engine of the type having a piston reciprocally movable in a cylinder in the crankcase of an engine, a carburetor, and a fuel reservoir, said method including the steps of providing the air-fuel mixture in the crankcase with an overabundance of fuel, reciprocating said piston in said cylinder to pump the fuel rich air fuel mixture into said cylinder, accumulating liquid fuel in a sump in said crankcase, said pumping the accumulated fuel in said sump back to the remote fuel reservoir at a point above the normal level of fuel in the remote fuel reservoir during reciprocation of the piston.

16. The method according to claim 15 including the step of observing the flow of liquid into the reservoir to determine whether sufficient liquid fuel is present to start the engine.

* * * * *